US011229307B1

(12) United States Patent
Conrad

(10) Patent No.: US 11,229,307 B1
(45) Date of Patent: Jan. 25, 2022

(54) HANGING APPARATUS

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton (CA)

( * ) Notice: Subject to any disclaimer, the term of this patent is extended or adjusted under 35 U.S.C. 154(b) by 0 days.

(21) Appl. No.: 17/084,811

(22) Filed: Oct. 30, 2020

(51) Int. Cl.

| | |
|---|---|
| ***A47G 25/06*** | (2006.01) |
| ***A47B 47/00*** | (2006.01) |
| ***A47B 43/00*** | (2006.01) |
| ***A47F 5/08*** | (2006.01) |
| ***A47F 5/10*** | (2006.01) |
| ***A47B 46/00*** | (2006.01) |
| ***A47B 96/02*** | (2006.01) |

(52) U.S. Cl.
CPC ..... *A47G 25/0664* (2013.01); *A47B 43/00* (2013.01); *A47B 46/005* (2013.01); *A47B 47/0075* (2013.01); *A47F 5/08* (2013.01); *A47F 5/10* (2013.01); *A47B 96/025* (2013.01)

(58) Field of Classification Search
CPC ..... A47G 25/0664; A47B 43/00; A47B 47/0075; A47B 96/025; A47B 96/027; A47B 96/02; A47B 45/00; A47B 46/005; A47B 46/00; A47B 57/045; A47F 5/08; A47F 9/042; A47F 5/10; A47F 5/0037
USPC ..... 211/189, 35, 36, 38, 90.02, 104, 149, 211/153, 150, 144, 88.02; 108/42, 115; 312/258, 262
See application file for complete search history.

(56) References Cited

U.S. PATENT DOCUMENTS

| | | | | | |
|---|---|---|---|---|---|
| 385,153 | A * | 6/1888 | Tolman | A47G 25/0685 | 211/104 |
| 1,089,882 | A * | 3/1914 | Thomas | A47G 25/0685 | 211/96 |
| 2,344,339 | A * | 3/1944 | Zwald | B60R 7/10 | 224/482 |
| 2,947,423 | A * | 8/1960 | Ekstrom | A47G 25/06 | 108/30 |
| 3,797,905 | A * | 3/1974 | Naske | A47B 43/00 | 312/262 |
| 3,800,957 | A * | 4/1974 | Krause | A47L 19/04 | 211/41.3 |
| 3,863,575 | A * | 2/1975 | Kuns | A47B 43/02 | 108/179 |
| 3,977,689 | A * | 8/1976 | Rosa | B62B 3/025 | 280/33.996 |
| 4,099,809 | A * | 7/1978 | Leotta | A47B 43/00 | 312/140.2 |
| 4,151,803 | A * | 5/1979 | Ferrera | A47F 5/116 | 108/179 |
| 4,445,731 | A * | 5/1984 | Ahmann | A47B 43/00 | 235/50 B |
| D283,568 | S * | 4/1986 | Valley | D6/682.2 | |
| 4,854,456 | A * | 8/1989 | Lee | A47B 81/007 | 211/14 |

(Continued)

*Primary Examiner* — Jennifer E. Novosad
(74) *Attorney, Agent, or Firm* — Philip C. Mendes da Costa; Bereskin & Parr LLP/S.E.N.C.R.L., s.r.l.

(57) ABSTRACT

An apparatus for hanging clothing or sports equipment that is removably mountable in a locker cubby and may be reconfigured from a closed position in which the apparats lies generally flat for transport and an open in use position wherein multiple locations are provided to support clothing and sports equipment.

15 Claims, 12 Drawing Sheets

(56) References Cited

U.S. PATENT DOCUMENTS 4,936,467 A * 6/1990 Bobeczko ..... A47F 7/00 211/14
5,257,701 A * 11/1993 Edelson ..... A47B 3/10 108/116
5,273,169 A * 12/1993 Maglione ..... A47F 5/116 108/162
5,315,936 A * 5/1994 Smith ..... A47F 5/116 108/165
5,465,851 A * 11/1995 Smith ..... A47F 5/0807 108/162
5,480,058 A * 1/1996 Hutchins ..... A47B 5/04 206/549
5,738,230 A * 4/1998 Goldstein ..... A47B 43/00 211/149
5,765,702 A * 6/1998 Bustos ..... A47F 5/137 211/149
5,871,105 A * 2/1999 Whitehead ..... A47B 81/00 211/14
5,882,098 A * 3/1999 Brown ..... A47B 3/0818 312/258
6,920,989 B2 * 7/2005 Lin ..... A47B 96/027 211/87.01
7,007,615 B2 * 3/2006 Grueneberg ..... A47B 43/02 108/165
7,500,574 B1 * 3/2009 Miller, III ..... A47B 43/00 211/106
7,571,820 B2 * 8/2009 Alexander ..... A47F 5/10 211/73
8,182,012 B1 * 5/2012 Brister ..... B60P 3/40 296/26.11
8,584,601 B1 * 11/2013 Deschner ..... B25H 1/04 108/135
8,584,872 B2 * 11/2013 Eiseman ..... A47B 97/08 211/130.1
9,302,717 B1 * 4/2016 Rude ..... B62D 33/0273
9,901,169 B1 * 2/2018 Schenker ..... A47B 43/00
10,548,425 B1 * 2/2020 Drozd ..... A47H 19/00
10,876,684 B1 * 12/2020 Drozd ..... A47B 43/00
2003/0057171 A1 * 3/2003 Wang ..... A47B 43/00 211/195
2003/0085640 A1 * 5/2003 Chan ..... A47B 43/00 312/262
2004/0261667 A1 * 12/2004 Ma ..... A47B 5/04 108/42
2005/0045569 A1 * 3/2005 Chang ..... A47B 43/00 211/11
2007/0051284 A1 * 3/2007 Shapiro ..... A47B 43/00 108/59
2011/0031200 A1 * 2/2011 Chen ..... A47B 43/00 211/149
2012/0111819 A1 * 5/2012 Chung ..... A47B 87/00 211/195
2012/0223209 A1 * 9/2012 Baylor ..... A47B 61/00 248/460
2014/0014675 A1 * 1/2014 Ingvarsson ..... A47K 5/06 221/155
2016/0213142 A1 * 7/2016 Vestergaard-Jensen ..... A47B 67/00
2019/0320792 A1 * 10/2019 Esposito ..... A47B 43/00

* cited by examiner

HANGING APPARATUS

FIELD

This application relates to the field of hanging apparel, such as clothing and sporting equipment.

INTRODUCTION

The following is not an admission that anything discussed below is part of the prior art or part of the common general knowledge of a person skilled in the art.

Various types of hanging apparatus are known, including clothes hangers and hooks fixed to a surface such as a wall or locker. Traditional lockers typically include several hooks, but there are often not enough hooks to properly hang multiple articles of apparel, nor space them sufficiently apart to dry the articles or prevent the transfer of odours. Additionally, if a user installs more hooks in their locker at, e.g. a hockey arena, they are unable to take the hooks with them when they visit different arenas.

SUMMARY

In accordance with this disclosure, a hanging apparatus is provided which may be hung in a locker by a user using the existing hooks for the locker. The hanging apparatus may be sized to fit in an existing locker cubby and provide additional hooks for hanging clothing and/or sports equipment and/or openings in which a hook of a clothes hanger may be received. Accordingly, the hanging apparatus may be supported by, for example, two hooks of a locker cubby (e.g., the hanging apparatus may have a back panel which has openings sized to receive the existing hooks of a locker cubby). Once mounted in the locker cubby using the existing hooks of a locker cubby, the hanging apparatus may increase the amount of clothing or sports equipment that may be hung in the locker cubby.

Optionally, the hooks in the locker cubby that are used to support the hanging apparatus may also be used to hand clothing and/or sports equipment.

Optionally, the hanging apparatus may be folded to a flat configuration which would assist a user in transporting the hanging apparatus. For example, a user may carry the hanging apparatus in their sports equipment bag. Once in the locker room, the user may unfold the hanging apparatus and mount it in the locker cubby provided to them. After a game is finished, the user may pack up their equipment and the hanging apparatus in their equipment bag and carry the hanging apparatus back home. Once home, it may be used to hang clothing and/or sports equipment to air and dry.

The hanging apparatus may have a back panel, a right side panel, a left side panel, and a shelf wherein each of the right side panel, the left side panel and shelf are rotatably mounted to the back panel and moveable between a folded position and an in use position. The shelf being may be supported in the in use position by the right side panel and the left side panel.

An advantage of this design is that the right side panel, the left side panel, and the shelf may be folded to reduce the size of the apparatus for transport or storage. When the apparatus is moved to the in use position, the right side panel, the left side panel, and the shelf provide a plurality of locations for clothing and/or sports equipment to be hung. Another advantage is that the plurality of locations for hanging articles provide additional spacing options to increase drying rates and prevent the transfer of odours between articles.

In accordance with this aspect, there is provided an apparatus for hanging clothing or sports equipment comprising:

a) a back panel having an upper end, a lower end, a front side, an opposed rear side and right and left opposed sides;

b) a right side panel rotatably mounted to the right side of the back panel, the right panel is moveable between a closed position in which the right side panel is rotated inwardly towards the front side of the back panel and an in use position in which the right side panel extends generally forwardly from the back panel;

c) a left side panel rotatably mounted to the left side of the back panel, the left panel is moveable between a closed position in which the left side panel is rotated inwardly towards the front side of the back panel and an in use position in which the left side panel extends generally forwardly from the back panel; and, d) a shelf rotatably mounted to the back panel and moveable between a folded position in which the shelf is rotated inwardly towards the front side of the back panel and an in use position in which the shelf extends generally transversely to the back panel, wherein the shelf is supported in the in use position by the right side panel and the left side panel.

In any embodiment, the back panel may have at least one member for removably receiving a hook provided on a support wall.

In any embodiment, the at least one member may comprise an opening provided on the upper end of the back panel.

In any embodiment, the right side panel may have a shelf engagement member, the left side panel may have a shelf engagement member, a right side of the shelf may have a right side panel engagement member and a left side of the shelf may have a left side panel engagement member wherein, when the shelf is in the in use position, the left side panel engagement member may engage the shelf engagement member of the left side panel and the right side panel engagement member may engage the shelf engagement member of the right side panel whereby the shelf may be secured in the in use position.

In any embodiment, at least one of the right side panel and the left side panel may have a hook member for removably receiving an item of clothing or sports equipment.

In any embodiment, at least one of the right side panel and the left side panel may have an opening for removably receiving a clothes hanger.

In any embodiment, when the right side panel and the left side panel are in the in use position, each of the right side panel and the left side panel may have a rearward side adjacent the back panel and a forward side, the forward side of at least one of the right side panel and the left side panel may have a hook member for removably receiving an item of clothing or sports equipment or a clothes hanger and the at least one of the right side panel and the left side panel may have an opening for removably receiving a clothes hanger.

In any embodiment, the forward side of the at least one of the right side panel and the left side panel may have a lower arcuate portion.

In any embodiment, the lower arcuate portion may have a plurality of hook members.

In any embodiment, the shelf may have a plurality of openings for removably receiving a clothes hanger.

In any embodiment, the lower end of the back panel may have hook members.

In any embodiment, the shelf may have an opening for removably receiving a clothes hanger.

In any embodiment, the opening may be arcuate.

In any embodiment, the right side panel and the left side panel may be each securable in the in use position.

In any embodiment, of the right side panel and the left side panel may be rotatable outwardly from the closed position to over 90° to an outermost rotated position and may be biased inwardly from the outermost rotated position.

In any embodiment, each of the right side panel and the left side panel may be rotatably mounted to the back panel by a rotational mount and the rotational mount may be securable in the in use position of the right side panel and the left side panel.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which.

Figure 1:
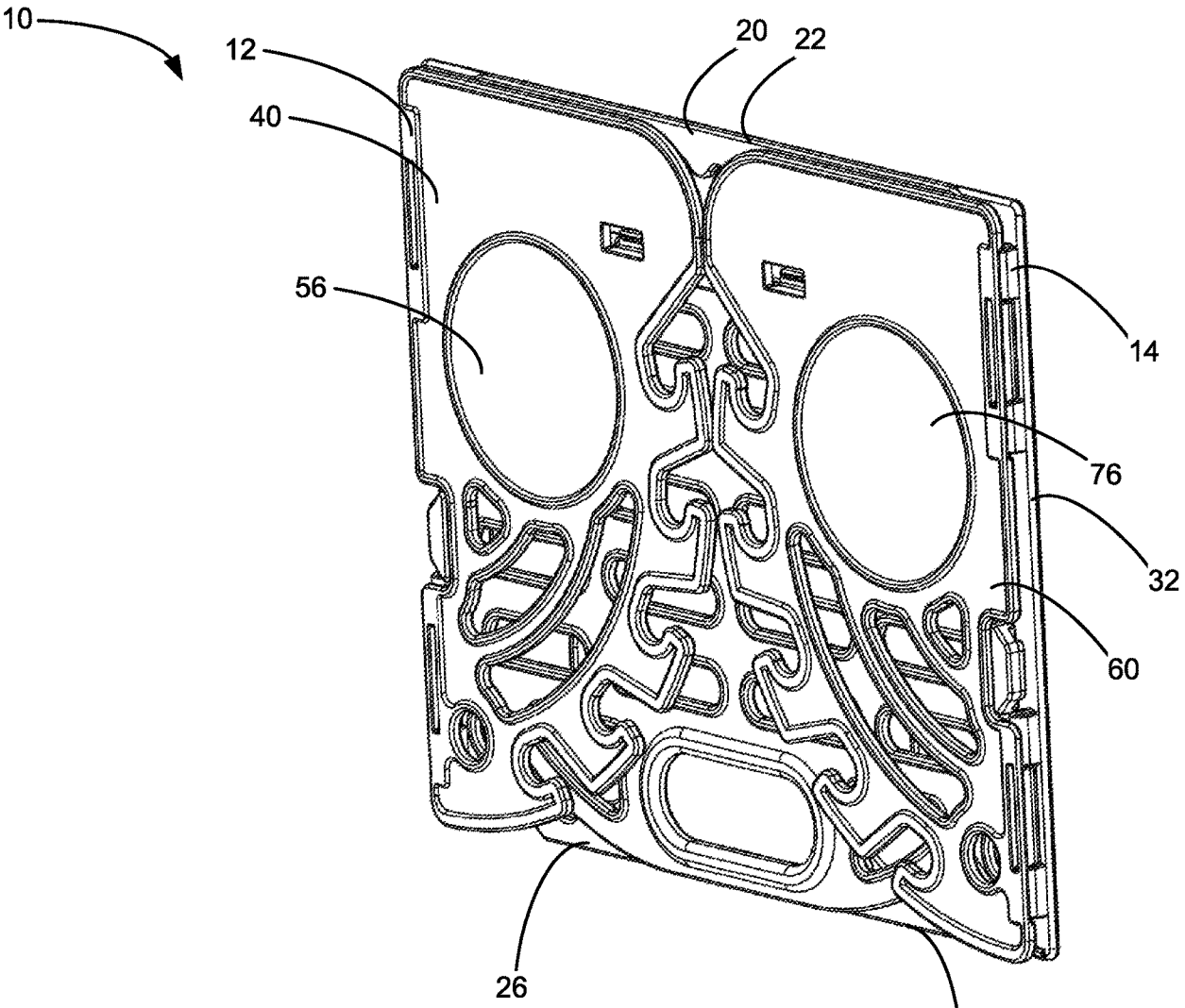
FIG. 1 is a front perspective view of an apparatus for hanging clothing or sports equipment in a closed configuration accordance with an embodiment.

The drawings included herewith are for illustrating various examples of articles, methods, and apparatuses of the teaching of the present specification and are not intended to limit the scope of what is taught in any way.

DESCRIPTION OF EXAMPLE EMBODIMENTS

Various apparatuses, methods and compositions are described below to provide an example of an embodiment of each claimed invention. No embodiment described below limits any claimed invention and any claimed invention may cover apparatuses and methods that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. None of the terms "coupled", "connected", "attached", and "fastened" distinguish the manner in which two or more parts are joined together.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

As used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

As used herein and in the claims, two elements are said to be "parallel" where those elements are parallel and spaced apart, or where those elements are collinear.

As exemplified in FIGS. 1-11, a hanging apparatus 10 for hanging apparel such as clothing or sports equipment has a back panel 20, a right side panel 40, a left side panel 60, and a shelf 80. The right side panel 40 and the left side panel 60 are also referred to as the right panel 40 and the left panel 60, respectively.

The hanging apparatus 10 may be secured to a support surface from which clothing and/or sports equipment may be hung, such as back panel 202 of cubby 200. Alternately, hanging apparatus may be removably mounted to any wall or locker. As exemplified in FIG. 12, the hanging apparatus 10 may be hung in a locker cubby 200 of the like. As exemplified in FIG. 12, the locker cubby has a back panel or wall 202 and two or more hooks 204. Typically, hooks 204 are configured to receive a hook of a clothes hanger or for clothes to be hung directly thereon.

Figure 2:
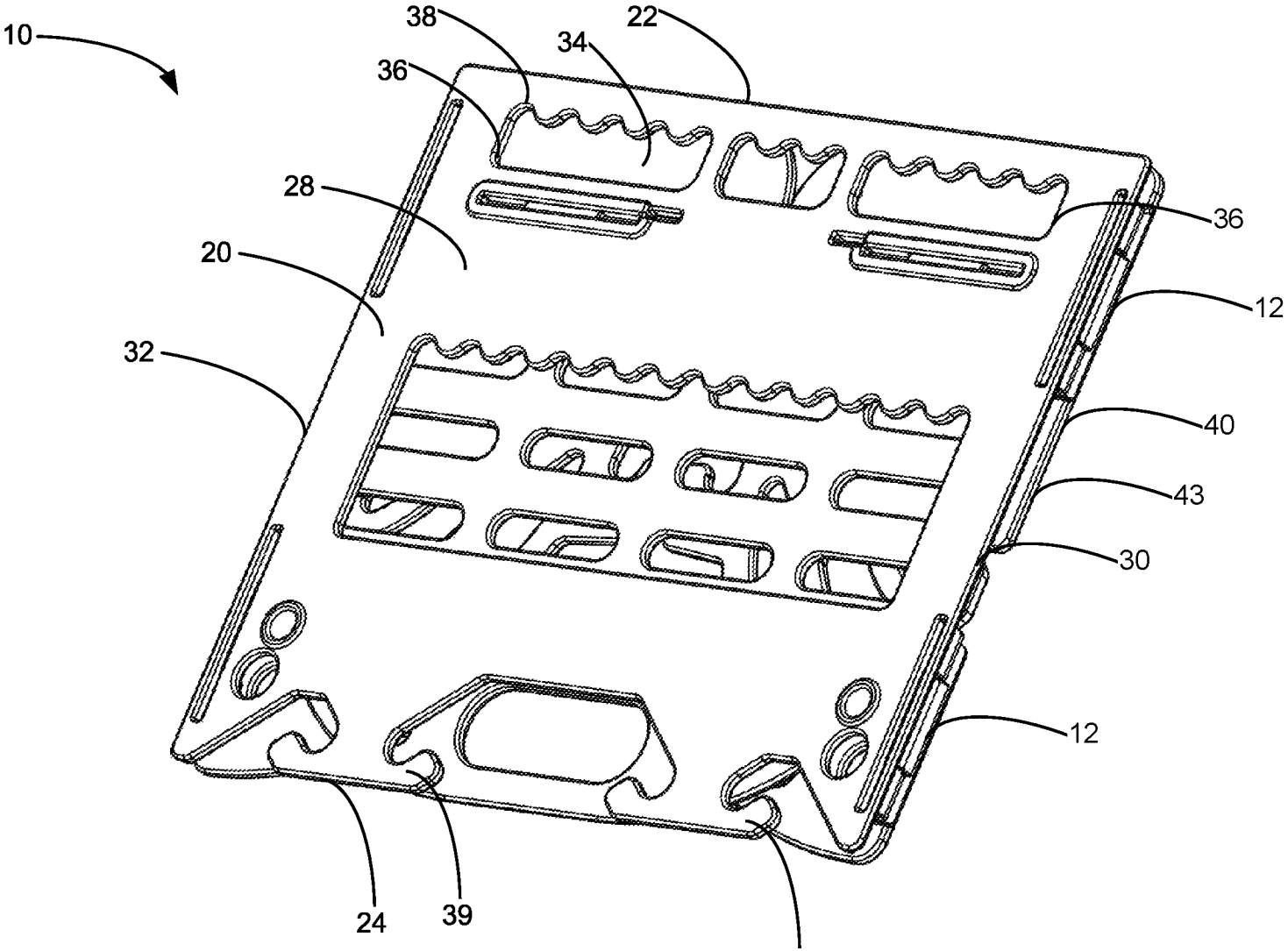
FIG. 2 is a rear perspective view of the apparatus of FIG. 1 in the closed configuration.

Referring to FIGS. 1-2, the back panel 20 has an upper end 22, a lower end 24, a front side 26, an opposed rear side 28, and right and left opposed sides 30, 32. Optionally, the back panel has a width between opposed sides 30, 32 which is less than the width of a typical locker cubby (see for example FIG. 12).

Figure 12:
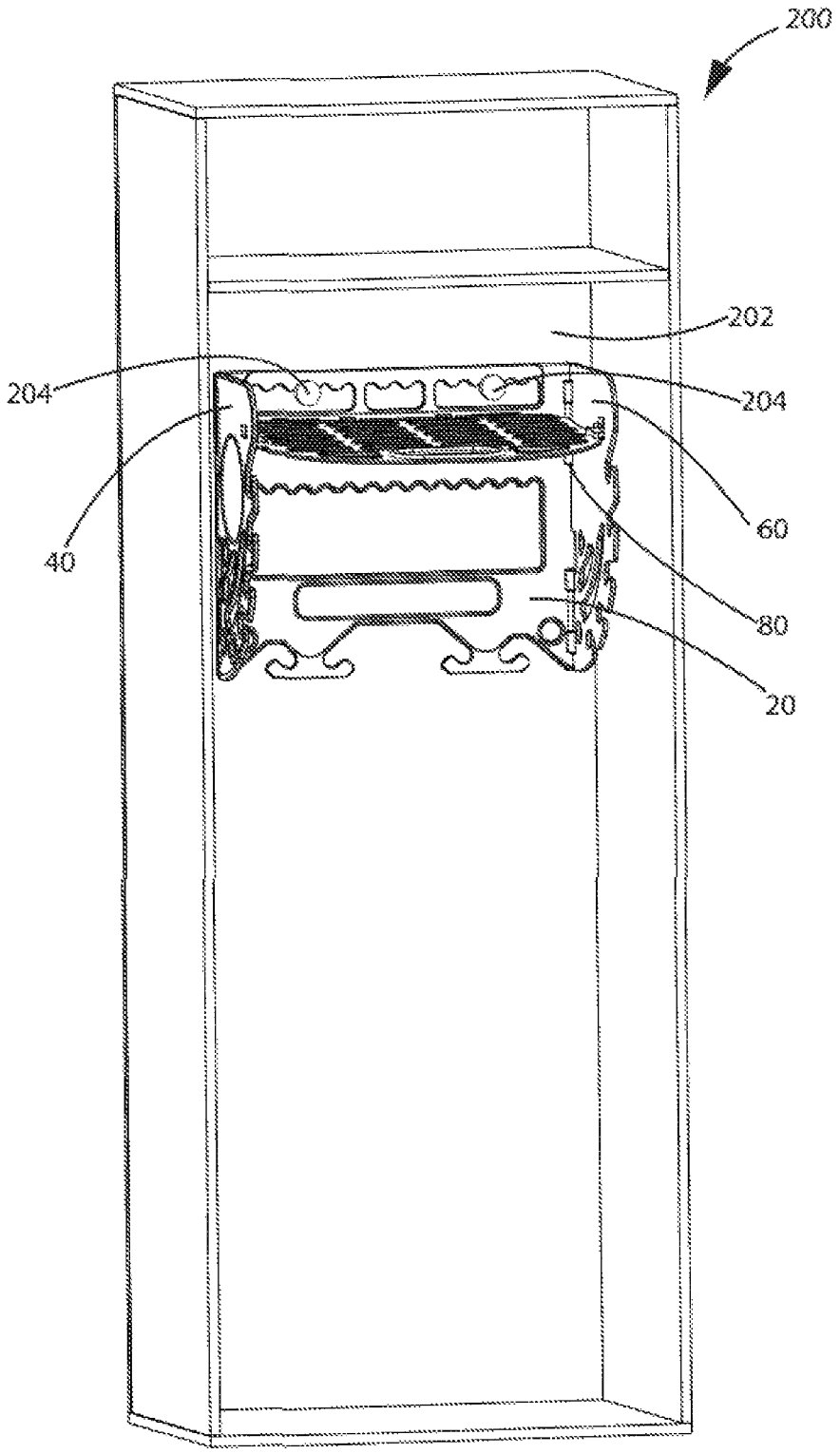

To secure the hanging apparatus 10 to a support surface, such as back panel 202 of a cubby 200 as exemplified in FIG. 12, the back panel 20 has one or more members 34 for removably receiving a protrusion provided on the support surface, such as hook 204 (See, e.g., FIG. 2). It will be appreciated that the members 34 may receive any form of protrusion from the support surface, such as a hook, screw, or nail. It will be appreciated that, optionally, at least two hooks 204 are used to support a hanging apparatus 10. Accordingly, back panel 20 may have two or more members 36, each of which is positioned to receive a hook in a typical cubby 200.

Members 34 may be of any configuration that may be used to mount hanging apparatus 10. For example, they may be cavities on the rear surface of back panel 20 that can receive a hook. Alternately, as exemplified in FIGS. 2 and 12, the plurality of members 34 are openings provided on the upper end 24 of the back panel 20. It will be appreciated that a single opening 36 may be provided or a plurality of openings 36 may be provided. As exemplified, a left and a right opening 36 are provided that extend about ⅓ of the width of the back panel. Using a longitudinally extending opening enables each opening to be easily positioned so as to receive a hook 204.

The openings 36 may be shaped to improve the stability of the hanging apparatus 10 when supported by a hook. As exemplified in FIG. 2, the openings 36 include a plurality of ridges 38 for stabilizing the hanging apparatus 10 on the support wall. Therefore, a hook 204 may be received in one of the ridges 38 of openings 36.

It will also be appreciated that the members 36 may be positioned in one or more locations on the back panel 20. For example, in some embodiments, members 36 may be positioned in the lower end 24, the upper end 22, both the upper and the lower end 22, 24, and/or one or more positions therebetween.

Accordingly, a user may position the hanging apparatus 10 on a support surface, such as a back panel 202 of a locker cubby 200. The hanging apparatus 10 increases the number of locations available to hang clothing and sporting equipment and provides increased spacing between hung articles. Increasing the available locations and spacing between hanging articles may increase drying rates and reduce the transfer of odours between hung articles.

Figure 3:
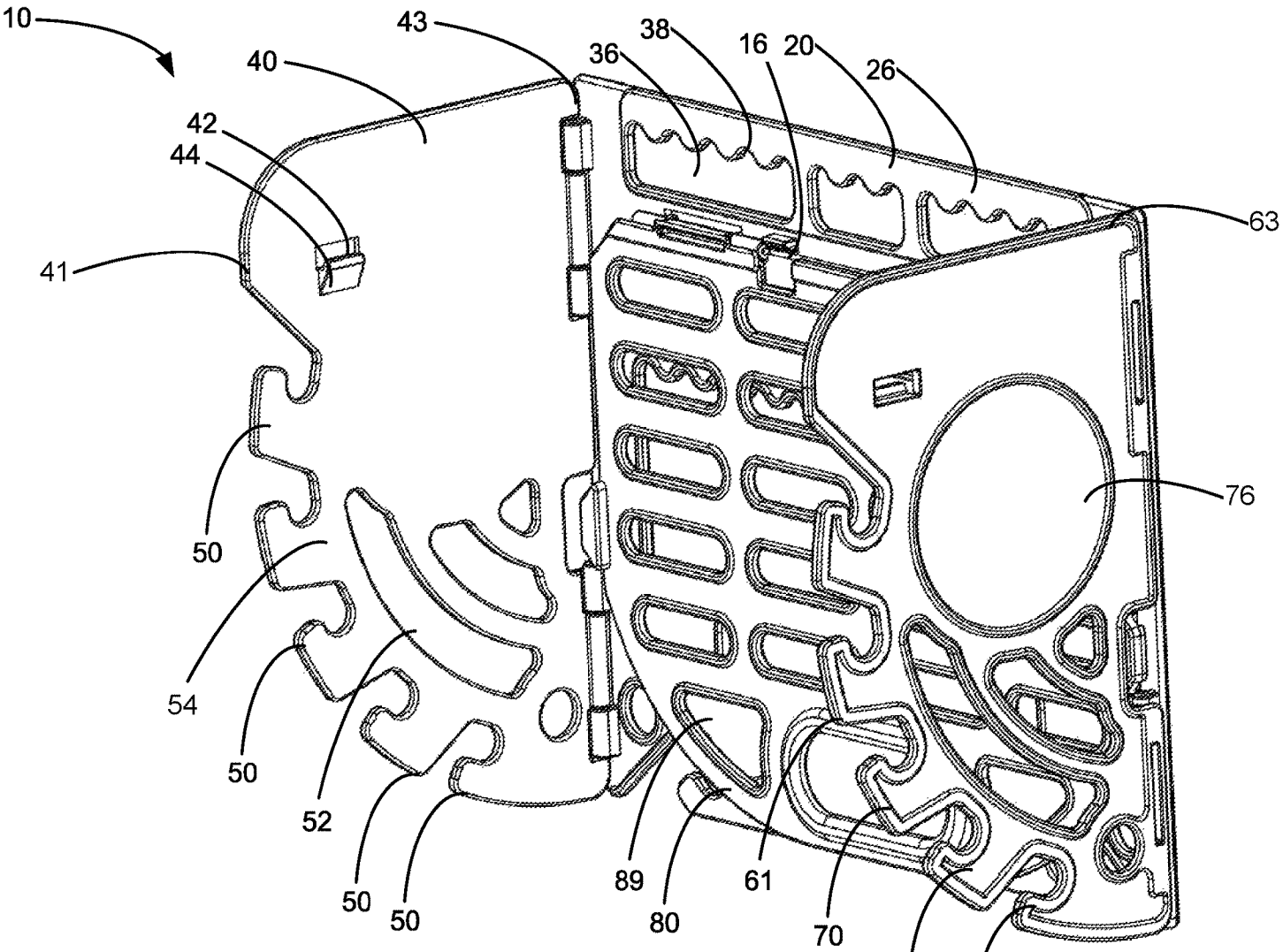
FIG. 3 is a front perspective view of the apparatus of FIG. 1 with the left side panel and the right side panel each in an in use position.
Figure 4:
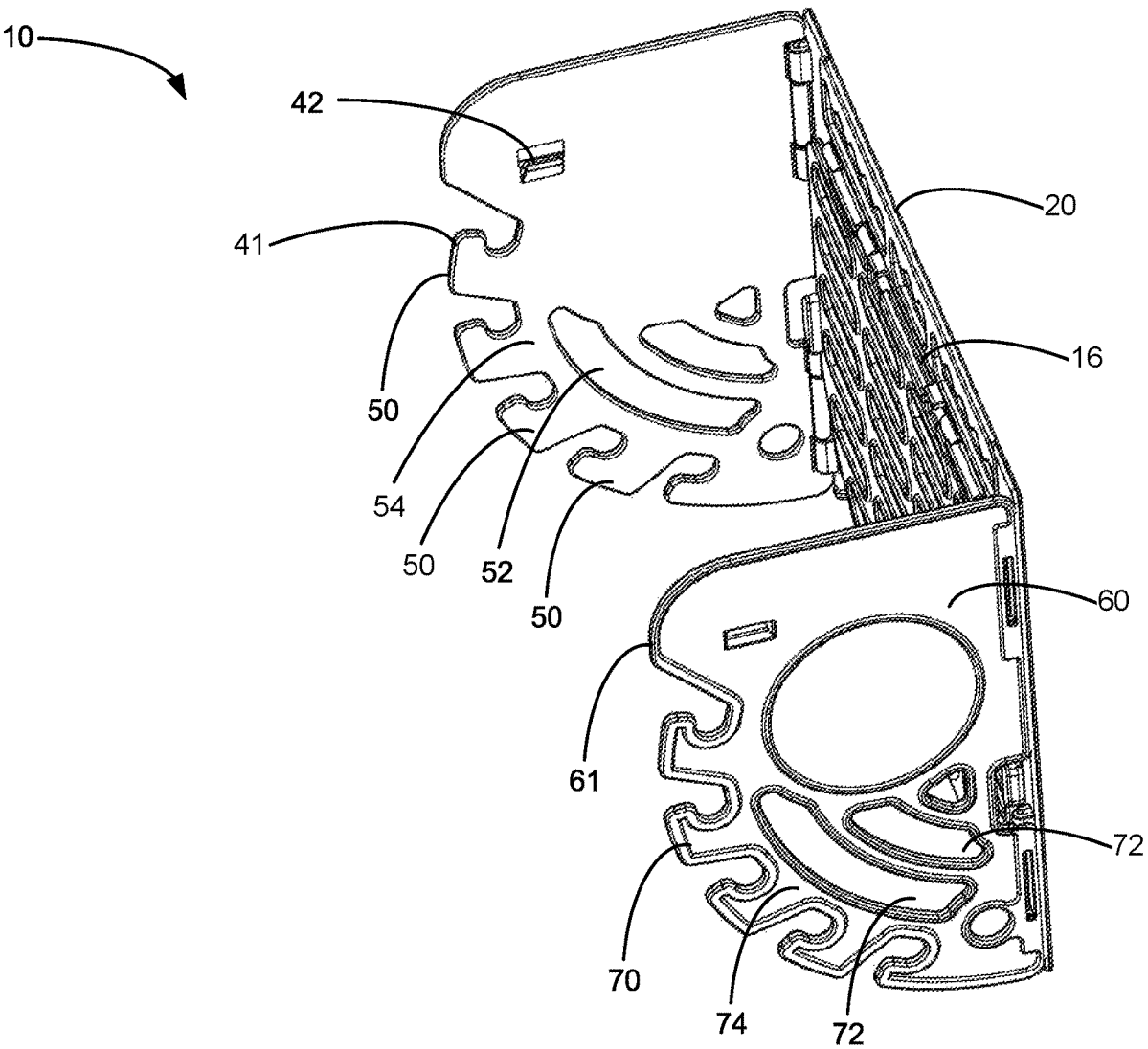
FIG. 4 is a top perspective view of FIG. 3.

Each of the right side panel 40 and the left side panel 60 are deployable from the closed position (e.g., FIGS. 1, 2) and the in use position (e.g., FIGS. 3, 4). Each panel may be rotatable mounted. For example, the right side panel 40 may be rotatably mounted to the right side 30 of the back panel 20 and the left side panel 60 may be rotatably mounted to the left side 32 of the back panel 20. Accordingly, as exemplified in FIG. 1, each of the right side panel 40 and the left side panel 60 is rotatably mounted to the back panel 20 by a rotational mount 12, 14, respectively. As exemplified, the rotational mounts 12, 14 are hinges. Alternately, each panel may be removably mounted to the back panel 20. Accordingly, for example, the right side panel 40 may have an engagement member that may be slid into a groove on the right side 30 of the back panel 20. Similarly, the left side panel 60 may have an engagement member that may be slid into a groove on the left side 32 of the back panel 20. When the hanging apparatus 10 is to be moved to the closed configuration, the side panels 40, 60 may be removed from back panel 20 and placed flat against, e.g., back panel 20.

Each of the back panel 20, the right side panel 40 and the left side panel 60 may be of any size and configuration. Optionally, each of the right side panel 40 and the left side panel 60 has a height that is about the same as the height of the back panel (from upper end 22 to lower end 24. The right side panel 40 and the left side panel 60 may have varying widths. As exemplified in FIG. 1, the maximum width of any portion of the right side panel 40 and the maximum width of any portion of the left side panel 60 may be half the width of the back panel 20. In such an embodiment, the right side panel 40 and the left side panel 60 may fold flat against shelf 80, if a shelf 80 is provided, when the hanging apparatus 10 is in the closed configuration of FIG. 1

As exemplified in FIGS. 1-11, the right panel 40 is moveable between a closed position, in which the right panel 40 is rotated inwardly towards the front side 26 of the back panel 20 (e.g. FIGS. 1-2 and 11) and an in use position in which the right panel 40 extends generally forwardly from the back panel 20 (e.g. FIGS. 3-10). Similarly, as exemplified in FIGS. 1-11, the left panel 60 is moveable between a closed position, in which the left panel 60 is rotated inwardly towards the front side 26 of the back panel 20 (e.g. FIGS. 1-2 and 11) and an in use position in which the left panel 60 extends generally forwardly from the back panel 20 (e.g. FIGS. 3-10). Optionally, in the closed position, the right side panel 40 and the left side panel 60 extend generally parallel to the back panel 20. If a shelf 80 is provided, then the right side panel 40 and the left side panel 60 may abut the shelf 80 when the hanging apparatus 10 is in the closed configuration of FIG. 1.

Figure 5:
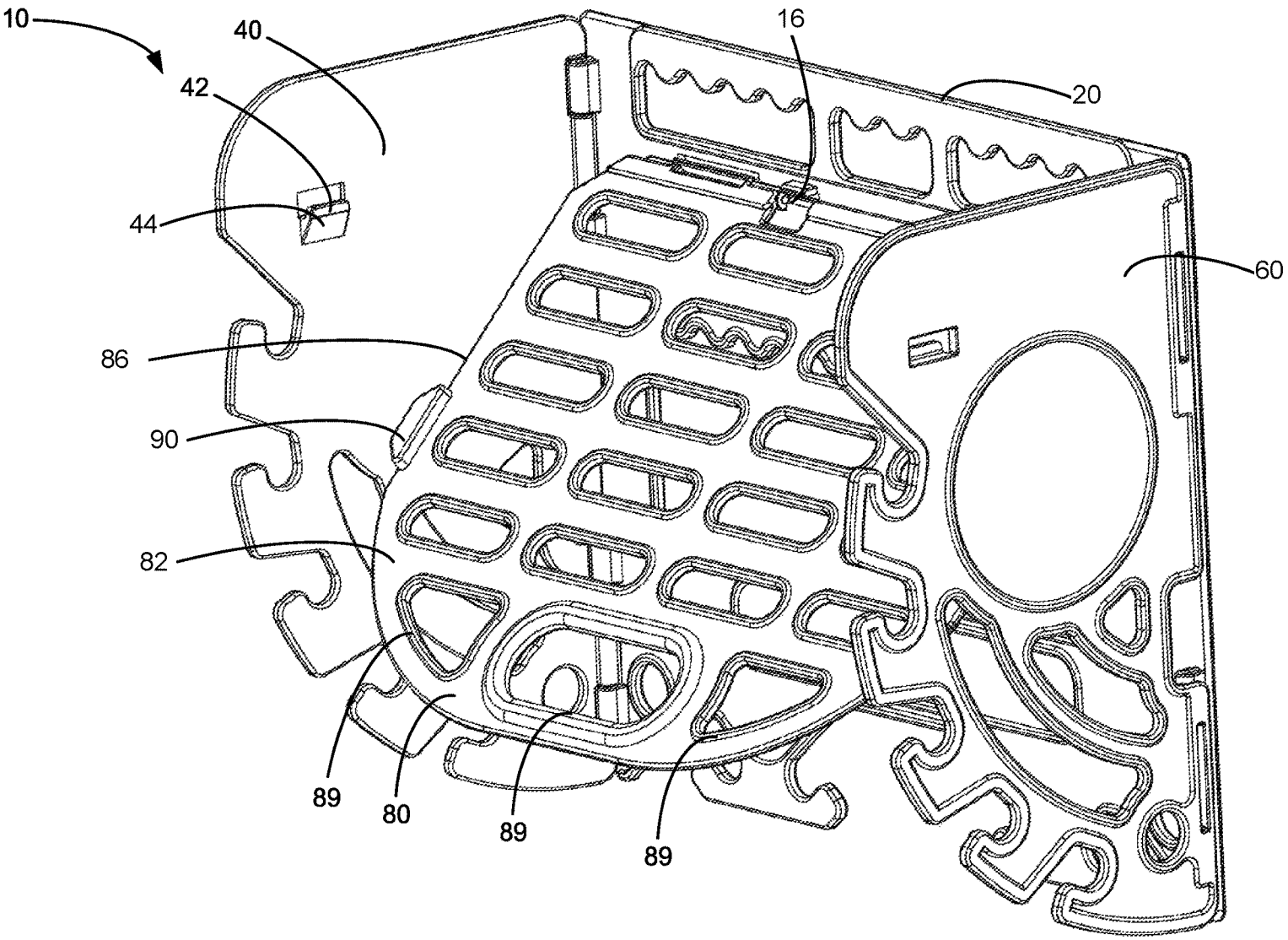
FIG. 5 is a front perspective view of the apparatus of FIG. 1 with the shelf rotated partially between a folded position and an in use position.

As exemplified in FIG. 5, the shelf 80 has a bottom end 82, a top end 84, a right side 86, and a left side 88. Top and bottom ends refer to the shelf 80 in the closed configuration of the hanging apparatus 10. The top end is the front end of the shelf 80 when the shelf 80 is in the in use position of FIG. 7 and the bottom end is the rear end of the shelf 80 when the shelf is in the in use position of FIG. 7.

The shelf 80 is rotatably mounted to the back panel 20 by a rotational mount 16, such as a hinge. Any hinge may be used. As exemplified in FIGS. 1-8, the shelf 80 is moveable between a folded position in which the shelf 80 is rotated inwardly towards the front side 26 of the back panel 20 (e.g. FIGS. 1-4), and an in use position in which the shelf 80 extends generally transversely to the back panel 20 (e.g. FIGS. 7-8 and 10). Optionally, in the closed configuration of FIG. 1, the shelf 80 may extend generally parallel to the back panel 20. Optionally, the rear side of the shelf 80 (in the configuration of FIG. 1) may abut the front side 26 of the back panel.

Optionally, as discussed subsequently, when the shelf 80 is in the in use position, the shelf 80 is supported, such as by the right panel 40 and the left panel 60.

Accordingly, during use, the right and left panels 40, 60 may be moved from their respective closed positions (FIGS. 1, 2) to their in use positions (FIGS. 3, 4). Next, the shelf 80 may be moved from the folded position (FIGS. 3, 4) to the in use position (FIGS. 5-7), whereby the shelf 80 is supported by the right panel 40 and the left panel 60.

Figure 7:
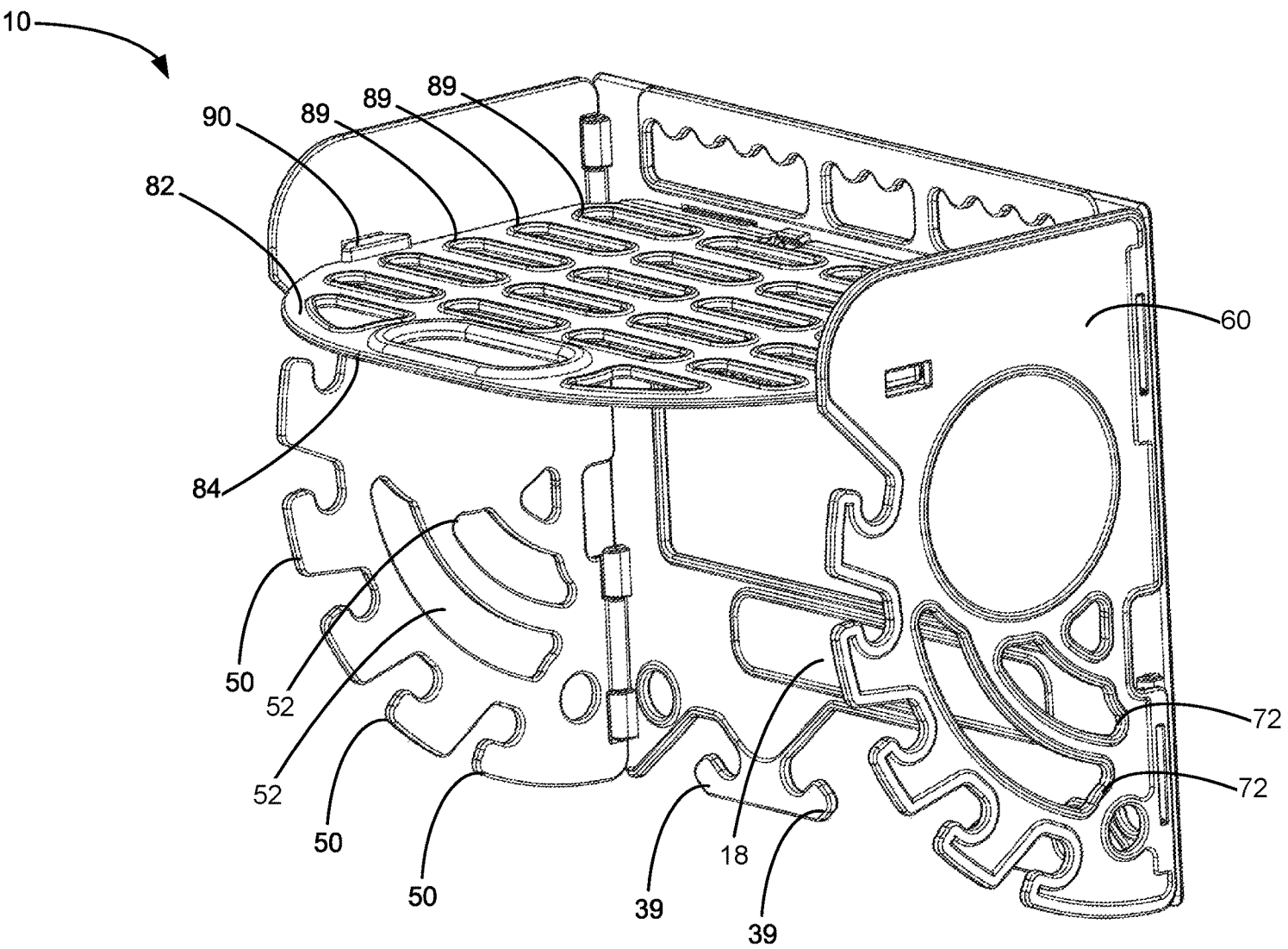
FIG. 7 is a front perspective view of the apparatus of FIG. 1 with the left side panel, right side panel, and shelf in the in use position.

Prior to configuring the hanging apparatus 10 to the in use position of FIG. 7, the hanging apparatus 10 may be hung up, such as in a locker cubby (see, e.g., FIG. 12). The right and left panels 40, 60 and the shelf 80 may then be moved to the in use position. Alternately the hanging apparatus 10 may be reconfigured to the in use configuration and then hung in a cubby.

Figure 11:
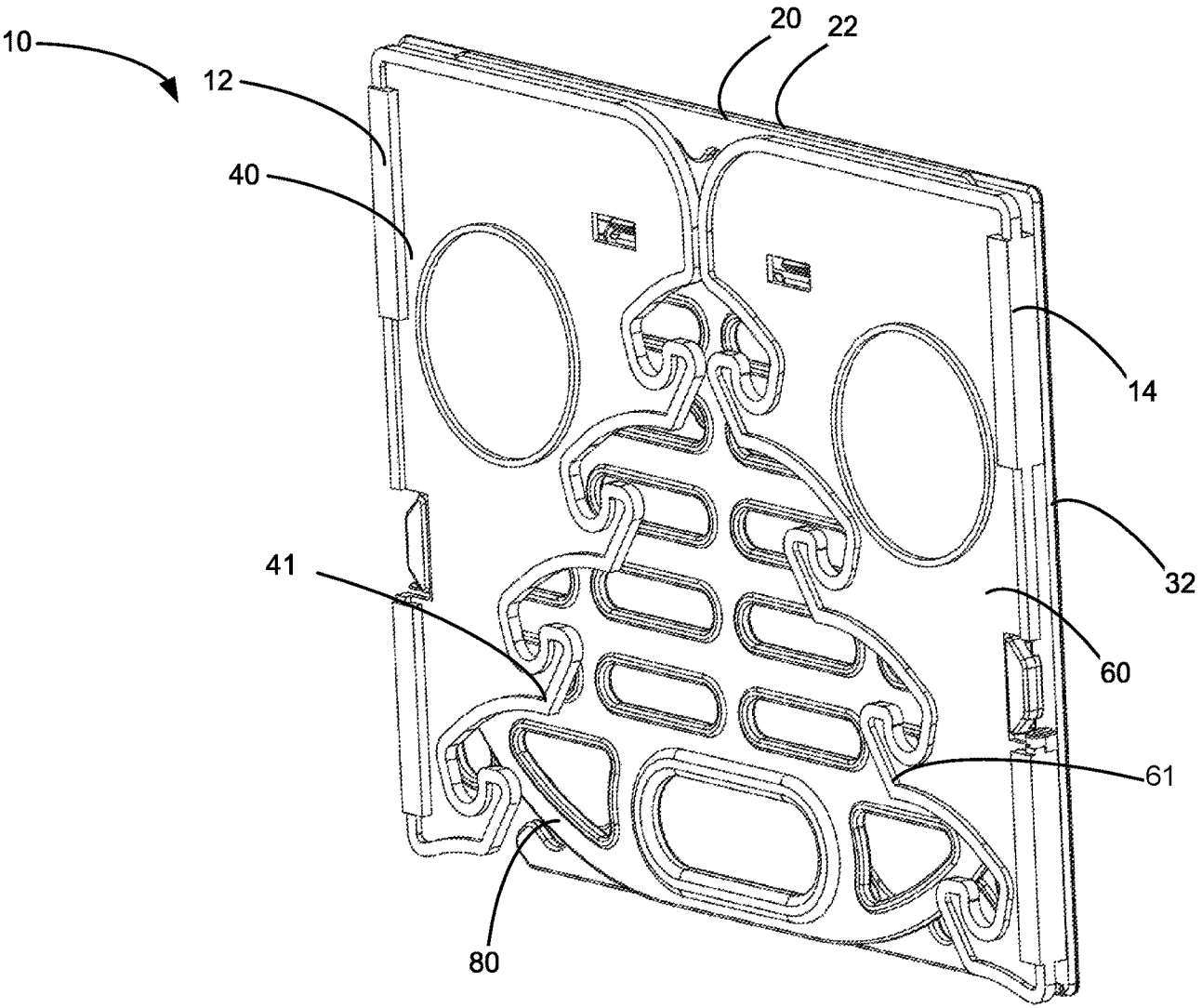
FIG. 11 is a front perspective view of an apparatus for hanging clothing or sports equipment in a closed in accordance with another embodiment; and, FIG. 12 is a front view of a hanging apparatus when hung in a locker cubby.

The hanging apparatus 10 may be folded to the closed position, as exemplified in FIGS. 1-2 and 11, allowing a user to more easily transport the hanging apparatus 10 with them. For example, a hockey player may wish to bring the hanging apparatus 10 with them to different arenas in order to better air out and store their equipment. The hanging apparatus 10 may be sized such that it can fit within a backpack, suitcase, or sports bag.

Optionally, the right side panel 40 and the left side panel 60 are securable in the in use position. It will be appreciated that the right and left side panels 40, 60 may be secured in the in use position by any means. For example, the rotational mounts 12, 14 may include a locking member to secure the rotational mounts 12, 14 in the in use position. Alternately, the back panel may have a locking members that engages with the right side panel 40 and the left side panel 60 to secure the right side panel 40 and the left side panel 60 in the in use position.

Alternately the shelf and the right and left side panels 40, 60 may inter-engage to secure the shelf in the in use position and the right side panel 40 and the left side panel 60 in the in use position. Accordingly, as exemplified in FIGS. 3 and 6, the right side panel 40 has a shelf engagement member 42 and the left side panel 60 has a shelf engagement member 62. As shown, the right side 86 of the shelf 80 has a right side panel engagement member 90 and the left side 88 of the shelf 80 has a left side panel engagement member 100. When the shelf 80 is rotated to the in use position (FIG. 10), the right side panel engagement member 90 engages the shelf engagement member 42 and the left side panel engagement member 100 engages the shelf engagement member 62, thereby securing the shelf 80 in the in use position. Furthermore, when the shelf 80 is secured in the in use position, the right side panel 40 and the left side panel 60 are each secured in the in use position.

The following describes in more detail the movement of the shelf to the in use position and uses the right side panel 40 as an example. It will be appreciated that the same features apply to the shelf engagement member 62 of left side panel 60 and the left side engagement member 100 of shelf 80.

Figure 9:
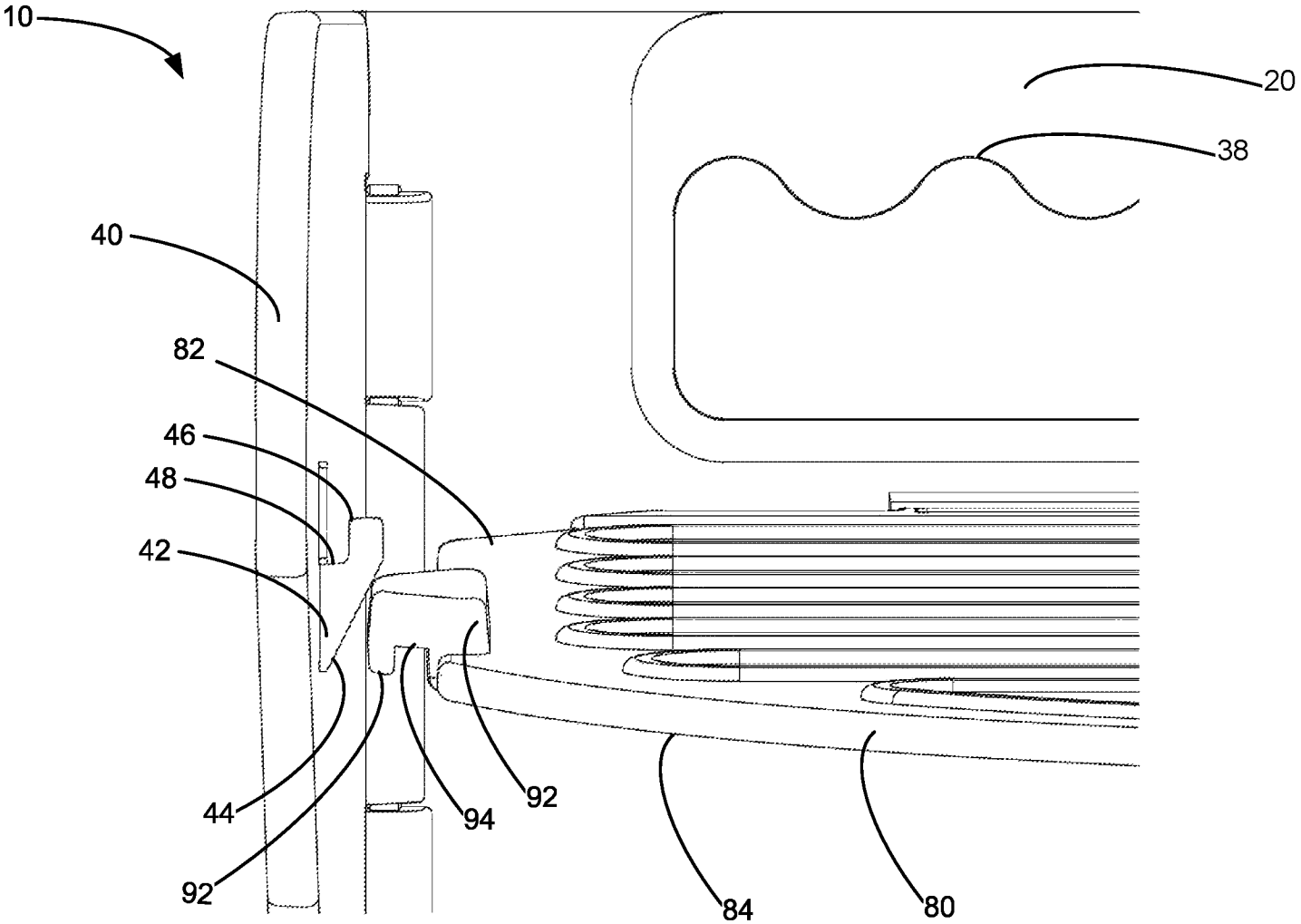
FIG. 9 is a front partial cut out view of the apparatus of FIG. 1 with the shelf rotated partially between the folded position and the in use position.
Figure 10:
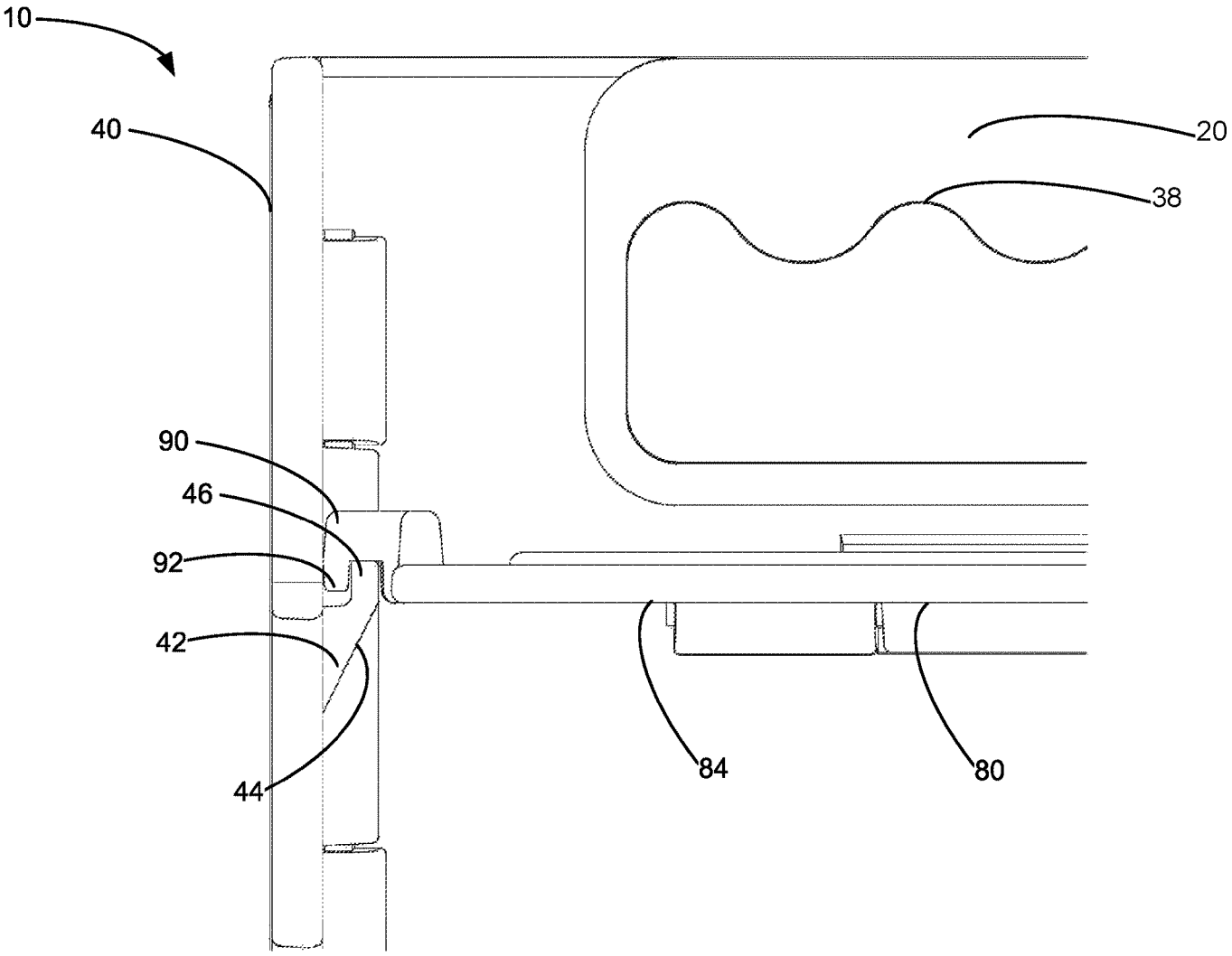
FIG. 10 is a front partial cut out view of the apparatus of FIG. 1 with the shelf in the in use position.

As shown more clearly in FIGS. 9 and 10, the shelf engagement member 42 on the right panel 40 has a guide surface 44. The guide surface 44 provides a surface for the right side panel engagement member 90 to follow as the shelf 80 is raised to the in use position. The shelf engagement member 42 has a protrusion 46 and a recess 48. The right side panel engagement member 90 has a correspondingly shaped protrusion 92 and recess 94.

The right side panel 40 may be biased inwardly from an outermost position of rotation such that the shelf engagement member 42 contacts the right side panel engagement member 90. Accordingly, as the shelf 80 is raised to the in use position, the right side panel engagement member 90 slides along the guide surface 44 until the right side panel engagement member 90 clears the protrusion 46. The recess 48 of the shelf engagement member 42 may then engage with the protrusion 92 of the right side panel engagement member 90 while the recess 94 of the right side engagement member 90 receives the protrusion 46 of the shelf engagement member 42. Accordingly, the right side panel 40 is secured in the in use position.

Figure 6:
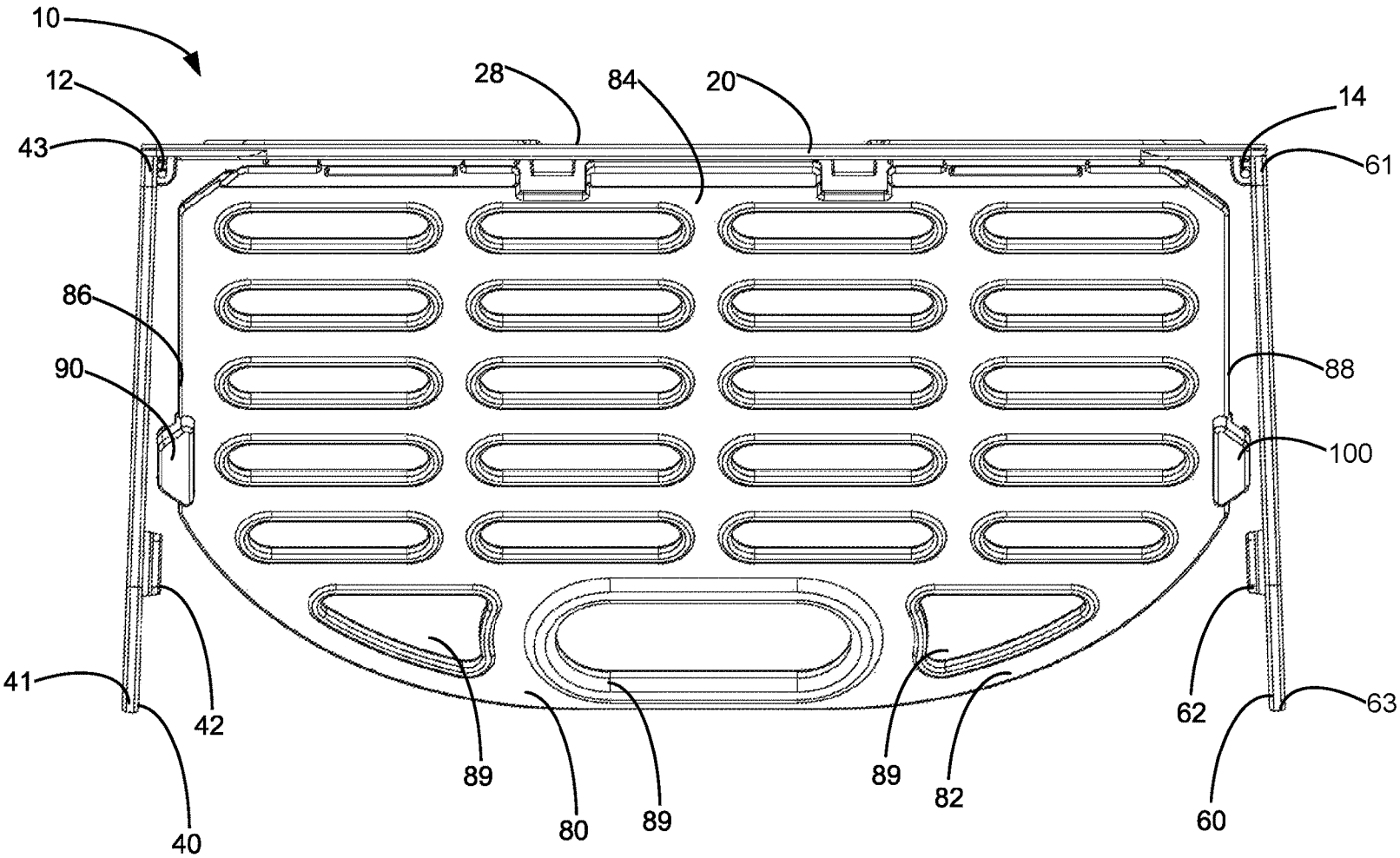
FIG. 6 is a top view of FIG. 5.

In other words, the right side panel 40 may be rotatable outwardly from the closed position over 90° to the outermost rotated position, as exemplified in FIGS. 6 and 9 The inward bias applied to the right panel 40 by, e.g., the rotational mount, allows the right side panel engagement member 90 to engage with the shelf engagement member 42 as the shelf 80 is raised to the in use position, as exemplified in FIG. 9. As exemplified, the right and left side panels 40 are formed of a material that is at least partially flexible to allow the panels 40, 60 to flex more than 90° from the back panel 20. It will be appreciated that the inward bias may be formed by any biasing means, such as, but not limited to, magnets, springs, and/or elastics. It will also be appreciated that the right and left panels 40, 60 may not be biased in any direction and a user may merely move the panels 40, 60 to the in use position once the shelf has been raised above the shelf engagement members 42, 62.

To move the right side panel 40 to the closed position, the shelf 80 may be raised and the right side panel 40 may be moved outward away from the shelf 80. Once the shelf engagement member 42 and the right side panel engagement member 90 are disengaged, the shelf 80 may be lowered and the right side panel 40 may be rotated inwardly towards the front side 26 of the back panel 20.

In alternate embodiments, the shelf 80 may be secured to the right and left side panels 40, 60 by, including but not limited to, magnets, a push and lock mechanism, a hook and loop fastening system, and/or adhesive strips.

It will be appreciated that clothing and/or sports equipment may be hung from the hanging apparatus 10 by various means. For example, clothing 110 and sports equipment 112 may be hung from one or more of the right panel 40, the left panel 60 and/or the shelf 80 and/or positioned on the shelf 80, as exemplified in FIG. 8.

The use of multiple hanging members may improve the drying rate and reduce the transfer of odours between hanging articles. Additionally, when in the closed position, the hanging members of the hanging apparatus 10 are folded inwardly, thereby protecting the hanging members from being damaged and protecting the user from contacting any sharp or pointed edges.

Optionally, as exemplified, one or both of the right side panel 40 may have a plurality of hook members 50 and the left side panel 60 has a plurality of hook members 70. The hook members 50, 70 may be used for removably receiving an item of clothing and/or sports equipment and or a clothes hanger 114. It will be appreciated that each of the right side panel and left side panel 40, 60 may have one or more hook members 50, 70.

Alternately, or in addition, one or both of the right and left side panels 40, 60 may have a plurality of openings 52, 72. The openings 52, 72 may be used for removably receiving a clothes hanger 114, as exemplified in FIG. 8. It will be appreciated that the right and left side panels 40, 60 may have one or more openings 52, 72.

Alternately, or in addition, the back panel 20 may include one or more hook members 39 (see FIG. 2). As exemplified, the hook members 39 are located on the lower end 24 of the back panel 20. It will be appreciated that the hook members 39 may be located anywhere on the back panel 20.

Figure 8:
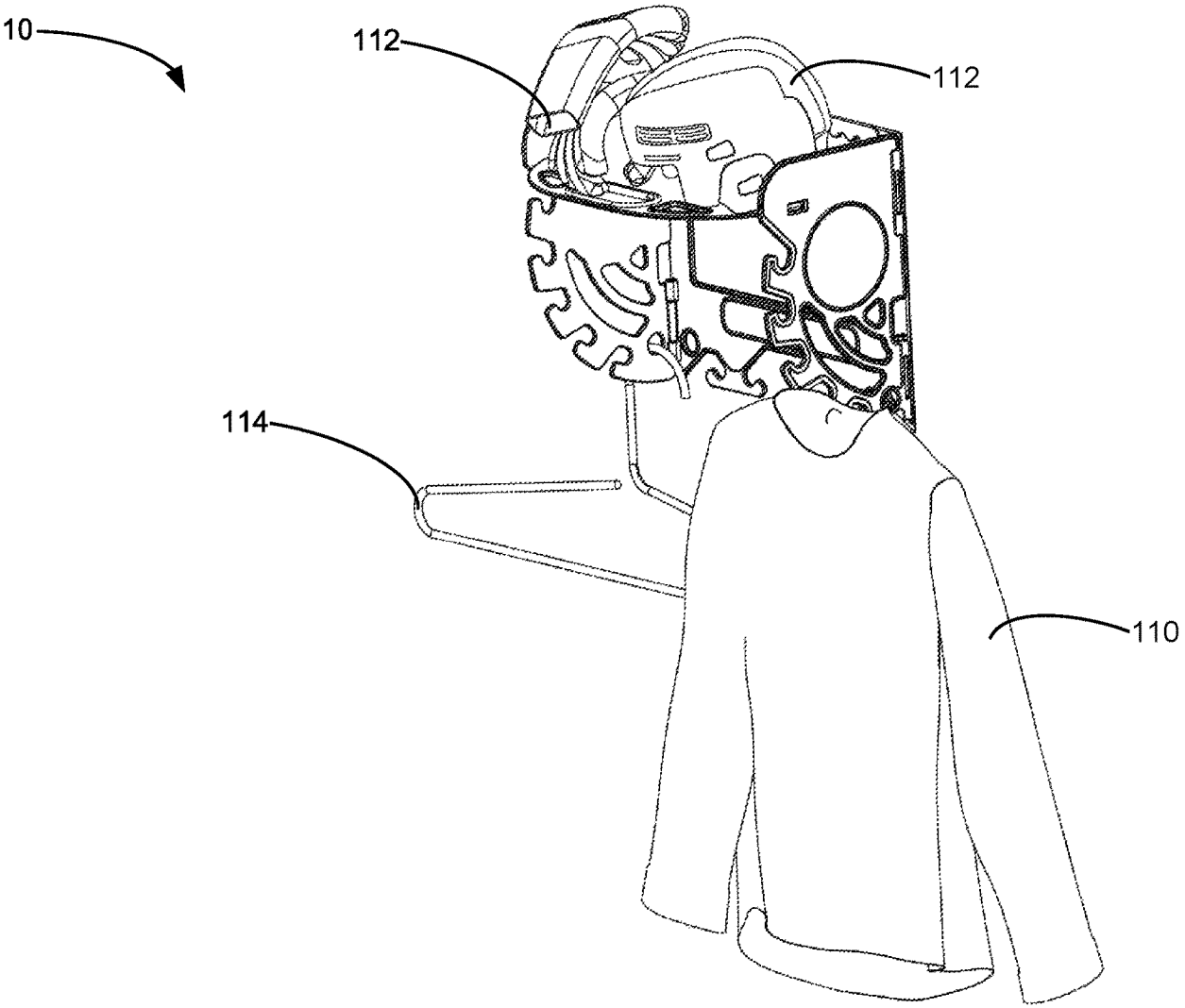
FIG. 8 is a front perspective view of the apparatus of FIG. 1 with exemplary clothing and sports equipment positioned on the apparatus.

Alternately, or in addition, the shelf 80 may have a plurality of openings 89 for removably receiving a clothes hanger 114, as illustrated in FIG. 8. It will be appreciated that the shelf 80 may have one or more openings 89. As shown more clearly in FIG. 5, the openings 89 may be various shapes and sizes. For example, at least one of the openings 89 may be arcuate. It will be appreciated that the openings 89 may be used for purposes other than hanging a clothes hanger, such as providing a handle to carry the hanging apparatus 10.

Optionally, the wall thickness of the various panels of the hanging apparatus 10 may be increased around the perimeter of the openings and hook members. The increased wall thickness provides increased strength to the hanging apparatus 10. Accordingly, heavier items such as a hockey jersey may be hung from the openings and/or hook members without damaging the hanging apparatus 10.

It will be appreciated that the hook members 50, 70 and openings 52, 72 may be located anywhere on the right and left side panels 40, 60. As exemplified in FIGS. 1-11, the right side panel 40 has a forward side 41 and a rearward side 43, adjacent the back panel 20. Similarly, the left side panel 60 has a forward side 61 and a rearward 63, adjacent the back panel 20. As exemplified, the hook members 50, 70 are located on the forward sides 41, 61.

As exemplified in FIGS. 1-10, the forward sides 41, 61 each have a lower arcuate portion 54, 74. The lower arcuate portions 54, 74 have a plurality of hook members 50, 70. The lower arcuate portions 54, 74 may allow a user to hang multiple articles of clothing and/or sporting equipment while separating the articles from each other and allowing the articles to be hung at varying heights to better promote drying and removal of odours.

It will be appreciated that the forward sides 41, 61 may be various shapes. In some embodiments, as exemplified in FIG. 11, the forward sides 41, 61 may be generally linear, such that a width of the right and left side panels 40, 60 decreases in a direction from the upper end 22 to the lower end 24 of the back panel 20 at a generally constant rate. In some embodiments, one of the right and left side panels 40, 60 may have an arcuate forward side 41, 61, while the other has a generally linear forward side 41, 61.

The hanging apparatus 10 may also include surfaces designed for the positioning of labels, such as a team logo or the name of the user. As exemplified in FIGS. 1-11, the right and left side panels 40, 60 each have a label surface 56, 76, respectively. Similarly, the back panel 20 has a label surface 18. A user may use the label surface 18 to position a name tag on the hanging apparatus 10. Furthermore, when in the closed position, the shelf 80 covers the label surface 18, thereby protecting it from damage during transit and/or storage.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. An apparatus for hanging clothing or sports equipment comprising:

(a) a back panel having an upper end, a lower end, a front side, an opposed rear side and right and left opposed sides;

(b) a right side panel rotatably mounted to the right side of the back panel, the right panel is moveable between a closed position in which the right side panel is rotated inwardly towards the front side of the back panel and an in use position in which the right side panel extends generally forwardly from the back panel;

(c) a left side panel rotatably mounted to the left side of the back panel, the left panel is moveable between a closed position in which the left side panel is rotated inwardly towards the front side of the back panel and an in use position in which the left side panel extends generally forwardly from the back panel; and, (d) a shelf rotatably mounted to the back panel and moveable between a folded position in which the shelf is rotated inwardly towards the front side of the back panel and an in use position in which the shelf extends generally transversely to the back panel, wherein the shelf is supported in the in use position by the right side panel and the left side panel wherein when the right side panel and the left side panel are in the in use position, each of the right side panel and the left side panel has a rearward side adjacent the back panel and a forward side, the forward side of the at least one of the right side panel and the left side panel has a lower arcuate portion which has a plurality of hook members.

2. The apparatus of claim 1 wherein the back panel has at least one member for removably receiving a hook provided on a support wall.

3. The apparatus of claim 2 wherein the at least one member comprises an opening provided on the upper end of the back panel.

4. The apparatus of claim 1 wherein the right side panel has a shelf engagement member, the left side panel has a shelf engagement member, a right side of the shelf has a right side panel engagement member and a left side of the shelf has a left side panel engagement member wherein, when the shelf is in the in use position, the left side panel engagement member engages the shelf engagement member of the left side panel and the right side panel engagement member engages the shelf engagement member of the right side panel whereby the shelf is secured in the in use position.

5. The apparatus of claim 1 wherein at least one of the right side panel and the left side panel has a hook member for removably receiving an item of clothing or sports equipment.

6. The apparatus of claim 1 wherein at least one of the right side panel and the left side panel has an opening for removably receiving a clothes hanger.

7. The apparatus of claim 1 wherein the forward side of at least one of the right side panel and the left side panel has a hook member for removably receiving an item of clothing or sports equipment or a clothes hanger and the at least one of the right side panel and the left side panel has an opening for removably receiving a clothes hanger.

8. The apparatus of claim 7 wherein the shelf has a plurality of openings for removably receiving a clothes hanger.

9. The apparatus of claim 8 wherein the lower end of the back panel has hook members.

10. The apparatus of claim 1 wherein the shelf has an opening for removably receiving a clothes hanger.

11. The apparatus of claim 10 wherein the opening is arcuate.

12. The apparatus of claim 1 wherein the right side panel and the left side panel are each securable in the in use position.

13. The apparatus of claim 1 wherein each of the right side panel and the left side panel is rotatable outwardly from the closed position over to 90° to an outermost rotated position and is biased inwardly from the outermost rotated position.

14. The apparatus of claim 13 wherein each of the right side panel and the left side panel is rotatably mounted to the back panel by a rotational mount and the rotational mount is securable in the in use position of the right side panel and the left side panel.

15. An apparatus for hanging clothing or sports equipment comprising:

(a) a back panel having an upper end, a lower end, a front side, an opposed rear side and right and left opposed sides;

(b) a right side panel rotatably mounted to the right side of the back panel, the right panel is moveable between a closed position in which an inner surface of the right side panel is rotated inwardly towards the front side of the back panel and an in use position in which the right side panel extends generally forwardly from the back panel, the inner surface of the right side panel has a right side shelf engagement member;

(c) a left side panel rotatably mounted to the left side of the back panel, the left panel is moveable between a closed position in which an inner surface of the left side panel is rotated inwardly towards the front side of the back panel and an in use position in which the left side panel extends generally forwardly from the back panel, the inner surface of the left side panel has a left side shelf engagement member wherein, when the right side panel and the left side panel are in the open position, the inner surface of the right side panel is opposed to and faces the inner surface of the left side panel; and, (d) a shelf rotatably mounted to the back panel and moveable between a folded position in which the shelf is rotated inwardly towards the front side of the back panel and an in use position in which the shelf extends generally transversely to the back panel, a right side of the shelf has a right side panel engagement member and a left side of the shelf has a left side panel engagement member;

wherein the right side shelf engagement member has a right side guide surface that is angled inwardly and a right side opening is provided between an upper end of right side guide surface and the right side panel, and wherein the left side shelf engagement member has a left side guide surface that is angled inwardly and a left side opening is provided between an upper end of left side guide surface and the left side panel, and wherein, as the shelf is raised to the in use position, the left side panel engagement member passes by over the left side guide surface until the left side panel engagement member is positioned above the left side guide surface and the right side panel engagement member passes by over the right side guide surface until the right side panel engagement member is positioned above the right side guide surface, and subsequently the shelf is rotated downwardly whereby the left side panel engagement member has a portion that seats in the left side opening and the right side panel engagement member has a portion that seats in the right side opening.

* * * * *